US011464299B1

(12) United States Patent
Lien

(10) Patent No.: US 11,464,299 B1
(45) Date of Patent: Oct. 11, 2022

(54) ZIPPER WITH LIGHT-EMITTING DEVICE AND CONTAINER WITH THE ZIPPER

(71) Applicant: Taiwan United Outdoor Group Inc., New Taipei (TW)

(72) Inventor: Chien-Ping Lien, New Taipei (TW)

(73) Assignee: Taiwan United Outdoor Group Inc., New Taipei (TW)

( * ) Notice: Subject to any disclaimer, the term of this patent is extended or adjusted under 35 U.S.C. 154(b) by 0 days.

(21) Appl. No.: 17/348,855

(22) Filed: Jun. 16, 2021

(30) Foreign Application Priority Data

May 3, 2021 (TW) ..... 110115892

(51) Int. Cl.

| | |
|---|---|
| ***A44B 19/34*** | (2006.01) |
| ***F21V 33/00*** | (2006.01) |
| ***F21V 23/06*** | (2006.01) |
| ***A45C 15/06*** | (2006.01) |
| ***A45C 13/10*** | (2006.01) |
| ***A44B 19/06*** | (2006.01) |
| ***A44B 19/32*** | (2006.01) |
| ***A44B 19/26*** | (2006.01) |

(52) U.S. Cl.
CPC ..... *A44B 19/34* (2013.01); *A44B 19/06* (2013.01); *A44B 19/26* (2013.01); *A44B 19/32* (2013.01); *A45C 13/103* (2013.01); *A45C 15/06* (2013.01); *F21V 23/06* (2013.01); *F21V 33/0004* (2013.01)

(58) Field of Classification Search
CPC ..... A44B 19/34; A44B 19/06; A44B 19/26; A44B 19/32; A45C 13/103; A45C 15/06; F21V 23/06; F21V 33/0004
See application file for complete search history.

(56) References Cited

U.S. PATENT DOCUMENTS

| | | | | |
|---|---|---|---|---|
| 2,565,895 A * | 8/1951 | Wadland | ..... | A45C 15/06 362/802 |
| 9,614,371 B1 * | 4/2017 | Farkas | ..... | A45C 15/06 |
| 10,076,163 B2 * | 9/2018 | Umekawa | ..... | A44B 19/24 |
| 10,477,928 B1 * | 11/2019 | Erdal | ..... | A44B 19/28 |

(Continued)

FOREIGN PATENT DOCUMENTS

| | | |
|---|---|---|
| CN | 105188456 A | 12/2015 |
| KR | 101653507 B1 | 9/2016 |
| TW | M425243 U | 3/2012 |

*Primary Examiner* — Robert Sandy
*Assistant Examiner* — Louis A Mercado
(74) *Attorney, Agent, or Firm* — Alan D. Kamrath; Karin L. Williams; Mayer & Williams PC

(57) ABSTRACT

A zipper includes a tape body including two zipper tapes each having an inner edge with a row of teeth. A stop includes a first end connected to distal ends of the rows of teeth and receives two first conductive plates. An end of one of the two first conductive plates is electrically connected to an electrode of at least one light-emitting element. A power connecting portion is electrically connected to another of the two first conductive plates and another electrode of the at least one light-emitting element. A slider is slidably disposed on the rows of teeth for engaging or disengaging the rows of teeth. The slider includes a second conductive plate configured to simultaneously contact with the two first conductive plates, causing electrical conduction to activate the at least one light-emitting element to emit light. A container with the zipper is also provided.

18 Claims, 12 Drawing Sheets

(56) References Cited

U.S. PATENT DOCUMENTS

| | | | | |
|---|---|---|---|---|
| 2007/0226966 | A1* | 10/2007 | Tominaga | A44B 19/32 24/389 |
| 2008/0201918 | A1* | 8/2008 | Takazawa | A44B 19/60 24/434 |
| 2010/0038276 | A1* | 2/2010 | Chen | A45C 13/02 24/399 |
| 2016/0153645 | A1* | 6/2016 | Leuty | A45C 15/04 362/184 |
| 2016/0183654 | A1* | 6/2016 | Leuty | A45C 5/02 362/156 |
| 2016/0345702 | A1* | 12/2016 | Zamora | A45C 13/103 |
| 2020/0292141 | A1* | 9/2020 | Marroncelli | A45C 15/06 |

* cited by examiner

ZIPPER WITH LIGHT-EMITTING DEVICE AND CONTAINER WITH THE ZIPPER

CROSS REFERENCE TO RELATED APPLICATION

The application claims the benefit of Taiwan application serial No. 110115892, filed on May 3, 2021, and the entire contents of which are incorporated herein by reference.

BACKGROUND OF THE INVENTION

1. Field of the Invention

The present invention relates to a zipper and a container with the zipper and, more particularly, to a zipper with a light-emitting device and a container with the zipper.

2. Description of the Related Art

FIG. 1 shows a conventional zipper 9 with a light-emitting device. The zipper 9 includes two rows of teeth 91. Each row of teeth 91 includes an end having an outer side with an electrical contact 92. A conductive slider 93 is slidably disposed on the two rows of teeth 91. When the conductive slider 93 slides to the ends of the two row of teeth 91, the conductive slider 93 contacts with the two electrical contacts 92 to cause electrical conduction between the two electrical contacts 92. Thus, the conductive slider 93, the two electrical contacts 92, a power unit 94, and a light-emitting unit 95 form a current loop. The power unit 94 supplies electrical current to the light-emitting unit 95 which emits light accordingly. The zipper 9 with the light-emitting device can be applied on a handbag 96. An example of the zipper 9 with the light-emitting device and the application on the handbag 96 is disclosed in Taiwan Utility Model No. M450254. When the zipper 9 is unzipped, the light-emitting unit 95 provides illumination for a receiving space in the handbag 96.

The above conventional zipper 9 with the light-emitting device can be used to seal an opening of the handbag 96. Since the two electrical contacts 92 are disposed on zipper tapes of the zipper 9 and are exposed on an outer face of the zipper 9. Thus, the two electrical contacts 92 are apt to contact with an electrically conductive external object outside of the receiving space, resulting in erroneous electrical conduction and erroneous lighting of the light-emitting unit 95. Furthermore, the two electrical contacts 92 could be in poor contact with the conductive slider 93 due to frictional wear by the conductive slider 93 or bending of the zipper 9, leading to an open circuit. As a result, the light-emitting unit 95 will not emit light and, thus, cannot provide illumination for the receiving space of the handbag 96.

In light of this, improvements to the conventional zipper with the light-emitting device and the container with the zipper are required.

SUMMARY OF THE INVENTION

To solve the above drawbacks, it is an objective of the present invention to provide a zipper with a light-emitting device which can avoid erroneous electrical conduction due to contact between the two electrical contacts and a conductive external object.

It is another objective of the present invention to provide a zipper with a lighting device which can avoid conduction failure due to frictional wear between the two electrical contacts and the slider of the zipper and bending of the zipper.

It is a further objective of the present invention to provide a zipper with a lighting device which can avoid erroneous electrical conduction due to moisture.

It is still another objective of the present invention to provide a zipper with a lighting device which can turn on the light by pulling the slider, providing stable illumination for the receiving space of the container.

As used herein, the terms "inner face" and "outer face" refer to a surface facing an internal space of a receiving device in which the zipper tape is disposed and a surface opposite to the internal space of the receiving device, respectively. These terms are used to assist in explanation and understanding the embodiments of the present invention rather than restriction.

As used herein, the term "a" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "coupling", "engagement", "assembly", or similar terms is used to include separation of connected members without destroying the members after connection or inseparable connection of the members after connection. A person having ordinary skill in the art would be able to select according to desired demands in the material or assembly of the members to be connected.

A zipper with a light-emitting device according to the present invention includes a tape body and a slider. The tape body includes two zipper tapes each including an inner edge having a row of teeth. A stop is coupled to the two zipper tapes and includes a first end connected to distal ends of the rows of teeth. The stop includes a second end opposite to the first end of the stop. The tape body further includes two first conductive plates received in the stop. Each of the two first conductive plates has a first end exposed outside of the first end of the stop. Each of the two first conductive plates has a second end located outside of a second end of the stop and received in a conduit of a connecting wire. The second end of one of the two first conductive plates is electrically connected to an electrode of at least one light-emitting element. A power connecting portion is electrically connected to the second end of another of the two first conductive plates and another electrode of the at least one light-emitting element. The slider is slidably disposed on the rows of teeth for engaging or disengaging the rows of teeth. The slider includes a second conductive plate configured to simultaneously contact with the two first conductive plates, causing electrical conduction to activate the at least one light-emitting element to emit light.

A container according to the present invention includes a body including a chamber having an opening for receiving and removing an object; and the above-mentioned zipper with the light-emitting device. The zipper is coupled to two edges of the opening. The power connecting portion is configured to be electrically connected to a power device. The at least one light-emitting element provides illumination for the chamber.

Thus, in the zipper with the light-emitting device according to the present invention and the container with the zipper, when the slider is pulled to the stop, the at least one light-emitting element emits light to illuminate the chamber of the container. When the slider is pulled to cause mutual engagement between the rows of teeth of the two zipper tapes, the light of the at least one light-emitting element is put out. Furthermore, the two first conductive plates are received in the stop. Thus, erroneous conduction of the two first conductive plates resulting from contact with conductive external objects can be avoided. Moreover, by the configuration that the first ends of the two first conductive plates are exposed outside of the first end of the stop, the first ends of the two first conductive plates provide electrical connection to achieve an effect of a switch. Furthermore, wear to the two first conductive plates resulting from frictional contact with the slider can be avoided. Further, unreliable conduction resulting from bending of the two zipper tapes is also avoided. Moreover, by the connection between the connection wire and the two first plates, a current loop is formed.

In an example, each of the two zipper tapes includes a waterproof material. Thus, the two zipper tapes provide liquid-tight and airtight effect.

In an example, the tape body further includes a reinforced portion connected to the second end of the stop. Thus, the reinforced portion can be used to fix the distal ends of the two zipper tapes to prevent disengagement of the distal ends of the two zipper tapes. Accordingly, the two zipper tapes can reliably seal an opening of a chamber.

In an example, the reinforced portion is in the form of a sheet having a plurality of holes. Thus, when the reinforced portion is bent, the plurality of holes provides extension spaces while the reinforced portion deforms, providing the reinforced portion with improved flexibility. Furthermore, the reinforced portion will not peel from the faces of the two zipper tapes during bending.

In an example, each of the two first conductive plates received in the stop has a bend. Thus, the bends provide the two first conductive plates with a height difference. As a result, the engaging area and the frictional force between each of the two first conductive plates and the stop can be increased, providing reliable engagement therebetween.

In an example, the first end of each of the two first conductive plates is at an inner face side of the two zipper tapes. Thus, the first ends of the two first conductive plates can be isolated to avoid contact with water or conductive external objects on the outer faces of the two zipper tapes, avoiding erroneous conduction between the first ends of the two first conductive plates.

In an example, the slider includes a groove receiving the second conductive plate, and the first end of the stop extends into the groove to provide press-fit therebetween. Thus, the second conductive plate in the groove and the first ends of the two first conductive plates can have reliable contact to assure stability of the current loop.

In an example, the groove includes an opening having a radial size which gradually increases outwards. Thus, the opening of the groove can form a guiding portion, such that the first end of the stop can extend into the groove along the guiding portion, providing easy alignment between the groove and the stop.

In an example, the groove includes a pressing block extending towards the opening of the groove and is associated with the first end of each of the two first conductive plates, and wherein the second conductive plate is coupled to an outer face of the pressing block. Thus, the second conductive plate can be securely positioned in the groove.

In an example, each of two ends of the second conductive plate includes a hook. The slider includes two lateral sides each having a lateral hole intercommunicating with the groove. Each hook extends through an associated one of the lateral holes and is hooked to a wall of the associated one of the lateral holes. Thus, the second conductive plate can be secured in the groove, avoiding disengagement of the second conductive plate.

In an example, the first end of the stop includes two recessed portions recessed from a face thereof. The first end of each of the two first conductive plates is exposed on a face of an associated one of the two recessed portions. The second conductive plate includes two protrusions extending into the two recessed portions, respectively. Thus, damage to the first end of each of the two first conductive plates resulting from frictional contact with an external object is avoided.

In an example, the container further includes an upper cover for covering the opening of the body. The at least one light-emitting element is disposed on the upper cover to emit light towards the chamber. Thus, the at least one light-emitting element can illuminate the chamber while avoiding occupation of space in the chamber.

In an example, the connecting wire is embedded in an interlayer of the upper cover and is electrically connected to the at least one light-emitting element. The power connecting portion is embedded in an interlayer of the body. Thus, the connecting wire and the power connecting portion can be received in the interlayers of the upper cover and the box body, avoiding exposure of the wire.

In an example, the body includes a side bag. The power connecting portion and the power device are received in the side bag. Thus, when the power device runs out of power, a user can easily remove the power device from the side bag for charging or replacement, providing enhanced use convenience.

In an example, the power connecting portion includes a coupler. Thus, the power device can be easily connected.

In an example, the coupler is a USB connector. Thus, the use convenience is enhanced.

In an example, the power device is a portable charger. Thus, the power device can be easily used or replaced, providing power storage and better power endurance.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
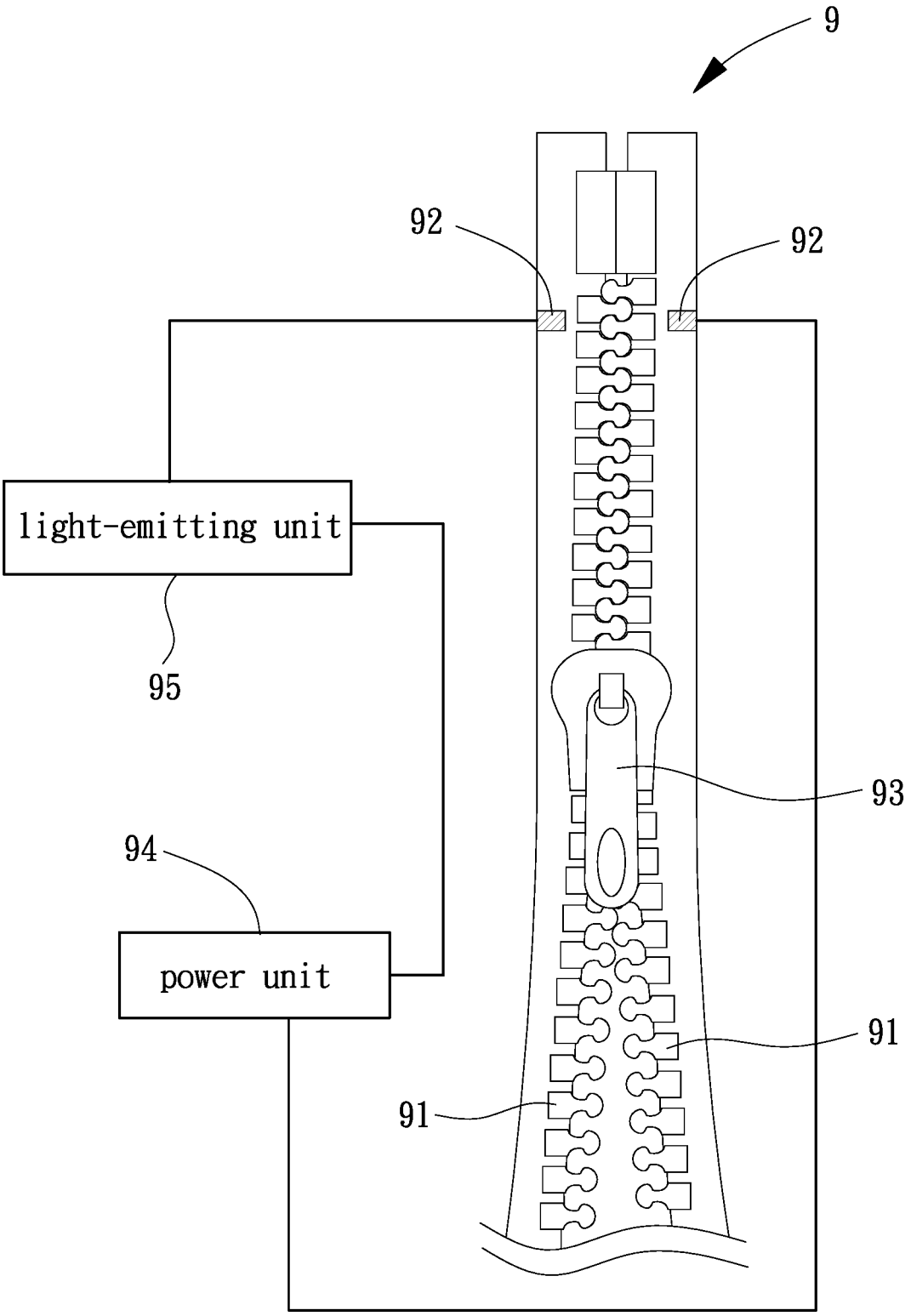
FIG. 1 PRIOR ART
FIG. 1 is a diagrammatic view of a conventional zipper with a light-emitting device.
Figure 2:
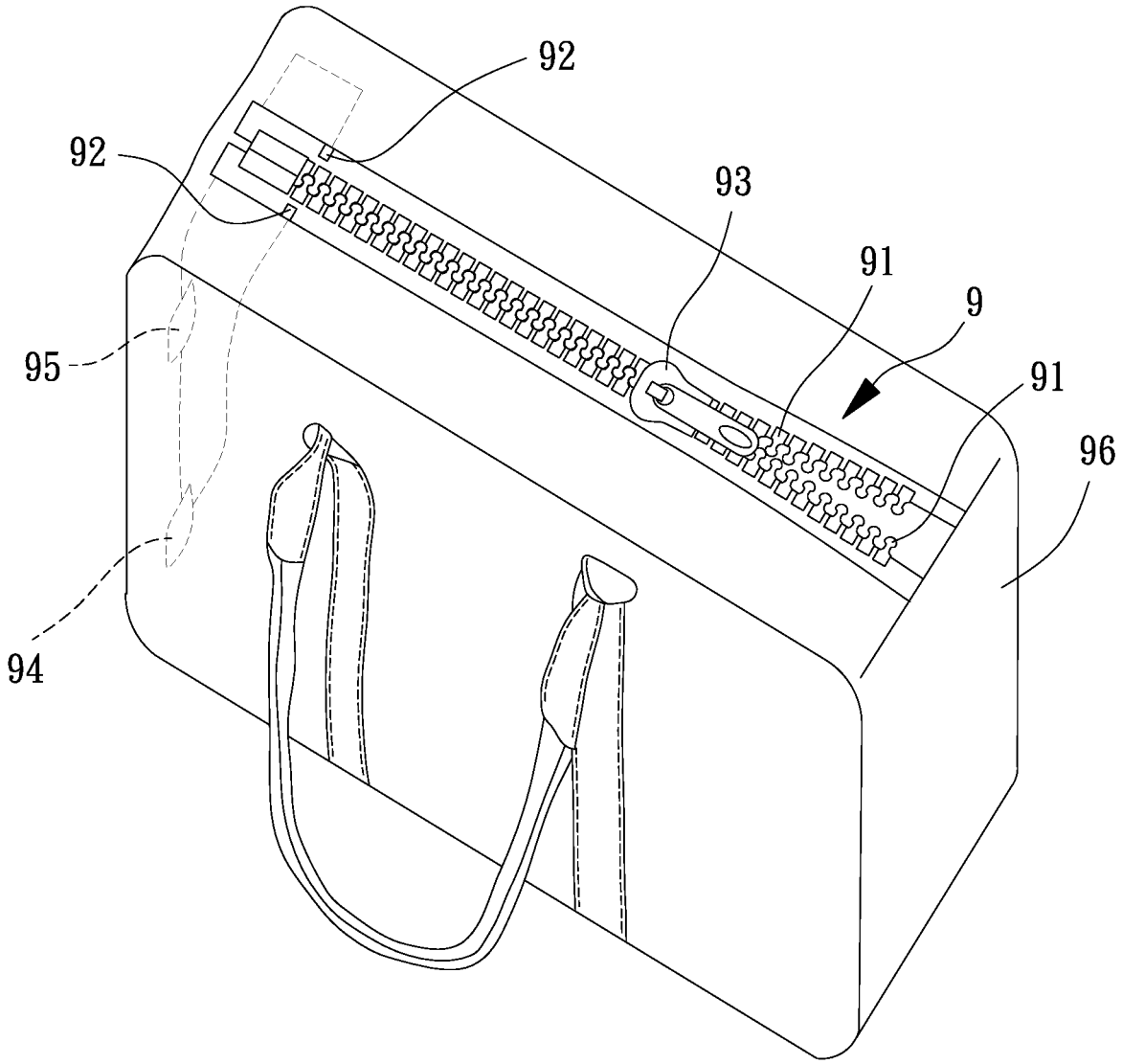
FIG. 2 PRIOR ART
FIG. 2 is a perspective view of a conventional handbag with a light-emitting device.

In the various figures of the drawings, the same numerals designate the same or similar parts. Furthermore, when the terms "front", "rear", "left", "right", "up", "down", "top", "bottom", "inner", "outer", "side" and similar terms are used hereinafter, it should be understood that these terms have reference only to the structure shown in the drawings as it would appear to a person viewing the drawings, and are utilized only to facilitate describing the invention, rather than restricting the invention.

DETAILED DESCRIPTION OF THE INVENTION

Figure 3:
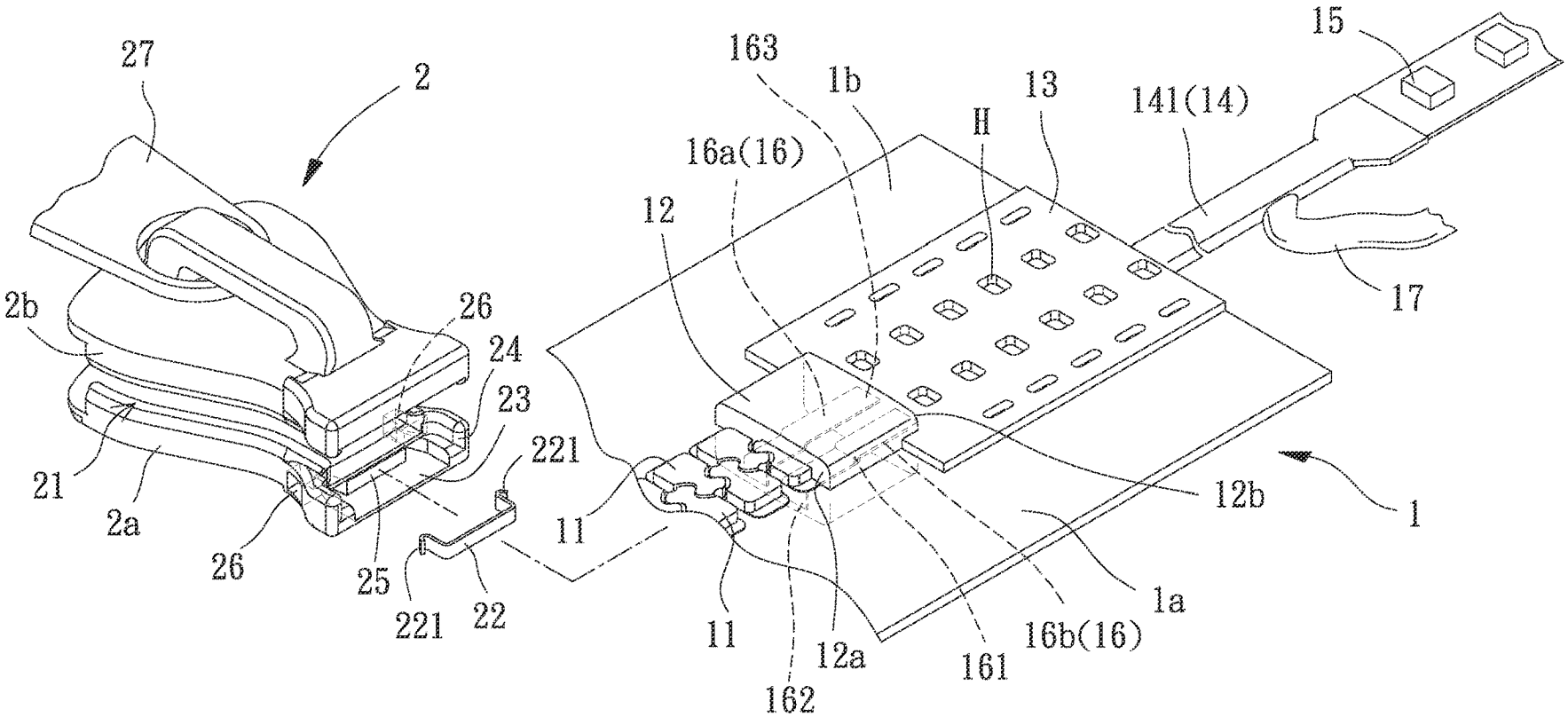
FIG. 3 is an exploded, perspective view of a first embodiment of a zipper according to the present invention.

With reference to FIG. 3, a zipper with a light-emitting device of a first embodiment according to the present invention includes a tape body 1 and a slider 2 slidable relative to the tape body 1.

As shown in FIG. 3, the tape body 1 includes two zipper tapes 1*a* and 1*b*. Each of the two zipper tapes 1*a* and 1*b* includes a row of teeth 11 disposed on an inner edge thereof and made of rigid plastic material. The rigid plastic material can be a thermoplastic resin, such as polyamide, polyoxymethylene, etc., and optional additives and mixtures. The rigid plastic material is disposed on the inner edge of each zipper tape 1*a*, 1*b* by injection molding. The two rows of teeth 11 can engage with or disengage from each other. Each zipper tape 1*a*, 1*b* preferably includes a waterproof layer which can envelope the zipper tapes 1*a* and 1*b* by extrusion or injection of heated thermoplastic elastomer, providing the zipper tapes 1*a* and 1*b* with liquid-tight and airtight effect.

The tape body 1 includes a stop 12. The stop 12 is preferably connected to distal ends of the rows of teeth 11 for stopping the slider 2. The outline of the stop 12 is not limited in the present invention. In this embodiment, the stop 12 is a parallelepiped. The stop 12 includes a first end 12*a* and a second end 12*b* opposite to the first end 12*a*. The stop 12 is connected to the distal ends of the rows of teeth 11 by the first end 12*a*. The stop 12 can be made of an elastomer. Preferably, the stop 12 is preferably formed by injection molding of a thermoplastic elastomer, such as thermoplastic polyurethane (TPU) or nylon, or synthetic rubber.

Preferably, the tape body 1 further includes a reinforced portion 13 formed on the distal ends of the two zipper tapes 1*a* and 1*b* by injection molding of a thermoplastic elastomer, such as thermoplastic polyurethane (TPU) or nylon, or synthetic rubber. The reinforced portion 13 can be connected to the second end 12*b* of the stop 12. The reinforced portion 13 is used to fix the distal ends of the two zipper tapes 1*a* and 1*b* to prevent disengagement of the distal ends of the two zipper tapes 1*a* and 1*b*. In this embodiment, the reinforced portion 13 is in the form of a sheet having a plurality of holes H. When the reinforced portion 13 is bent, the plurality of holes H provide extension spaces for deformation of the reinforced portion 13.

Figure 4:
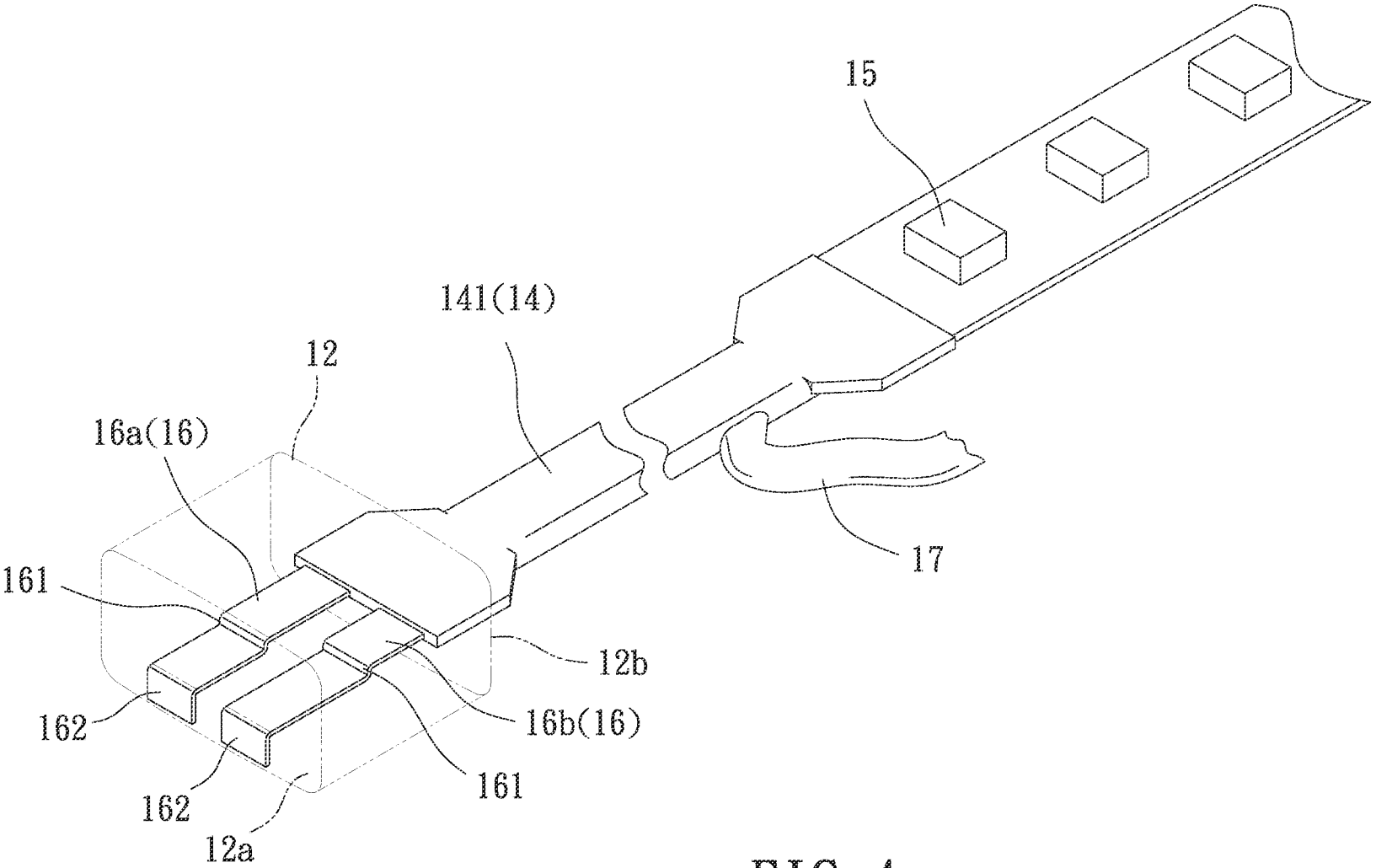
FIG. 4 is a partially enlarged view of a connecting wire of the zipper of the first embodiment according to the present invention.

With reference to FIGS. 3 and 4, the tape body 1 includes a connecting wire 14 having opposite first end second ends. The first end of the connecting wire 14 is electrically connected to at least one light-emitting element 15, such as a tungsten light bulb, a fluorescent tube, an electroluminescent (EL) lamp strip or an LED. In this embodiment, the at least one light-emitting element 15 is an LED lamp strip. The second end of the connecting wire 14 is electrically connected to two first conductive plates 16 (16*a*, 16*b*). More specifically, the connecting wire 14 includes a conduit 141 covering the connecting wire 14 inside, and each of the two first conductive plates 16 (16*a*, 16*b*) has a first end 162 and a second end 163 opposite to the first end 162. The second ends 163 of the two first conductive plates 16 (16*a*, 16*b*) are located outside of a second end 12*b* of the stop 12 and received in the conduit 141 of the connecting wire 14. The second end 163 of one of the two first conductive plates 16*a* is electrically connected to an electrode of the at least one light-emitting element 15. The second end 163 of the other first conductive plate 16*b* can receive input of an electric current. The two first conductive plates 16 (16*a*, 16*b*) can be made of a conductive material, such as copper, aluminum, etc. The present invention is not limited in this regard. The two first conductive plates 16 (16*a*, 16*b*) are received in the stop 12. Each of the two first conductive plates 16 (16*a*, 16*b*) can be in the form of a board. When the stop 12 is formed by injection, the two first conductive plates 16 (16*a*, 16*b*) are at least partially enveloped by the stop 12. Preferably, each of the two first conductive plates 16 (16*a*, 16*b*) further has a bend 161 to provide a height difference, forming a non-planar board. Thus, the engaging area and the friction between each of the two first conductive plates 16 (16*a*, 16*b*) and the stop 12 can be increased.

Furthermore, each of the two first conductive plates 16 (16*a*, 16*b*) has the first end 162 exposed outside of the first end 12*a* of the stop 12. In this embodiment, the first end 162 of each of the two first conductive plates 16 (16*a*, 16*b*) is flatly flush with a face of the first end 12*a* of the stop 12 by bending. Thus, the first ends 162 of the two first conductive plates 16 (16*a*, 16*b*) form two contacts for electrical connection. Preferably, the first end 162 of each of the two first conductive plates 16 (16*a*, 16*b*) is at an inner face side of the two zipper tapes 1*a* and 1*b*. Thus, by isolation of the two zipper tapes 1*a* and 1*b*, the first end 162 of each of the two first conductive plates 16 (16*a*, 16*b*) can be prevented from contacting with water or conductive external objects on the outer face of each of the two zipper tapes 1*a*, 1*b*.

The tape body 1 further includes a power connecting portion 17 which can be any conventional electrical connector (not shown). The present invention is not limited to the form of the electrical connector. The power connecting portion 17 can be connected to a power source. Furthermore, the power connecting portion 17 is electrically connected to another of the two first conductive plates 16*b* and another electrode of the at least one light-emitting element 15.

Still referring to FIG. 3, the slider 2 can be of any conventional structure. In this embodiment, the slider 2 includes a lower body 2*a* and an upper body 2*b*. Each of two lateral sides of the slider 2 further includes a slot 21 between the lower body 2*a* and the upper body 2*b*. Each row of teeth 11 is received in an associated slot 21. The slider 2 is movable on the rows of teeth 11 for engagement or disengagement of the rows of teeth 11. The lower body 2*a* and the upper body 2*b* of the slider 2 are on the inner face side and the outer face side of the zipper tapes 1*a*, 1*b*, respectively. The lower body 2*a* includes a second conductive plate 22 for electrical conduction of the two first conductive plates 16 (16*a*, 16*b*).

Figure 5:
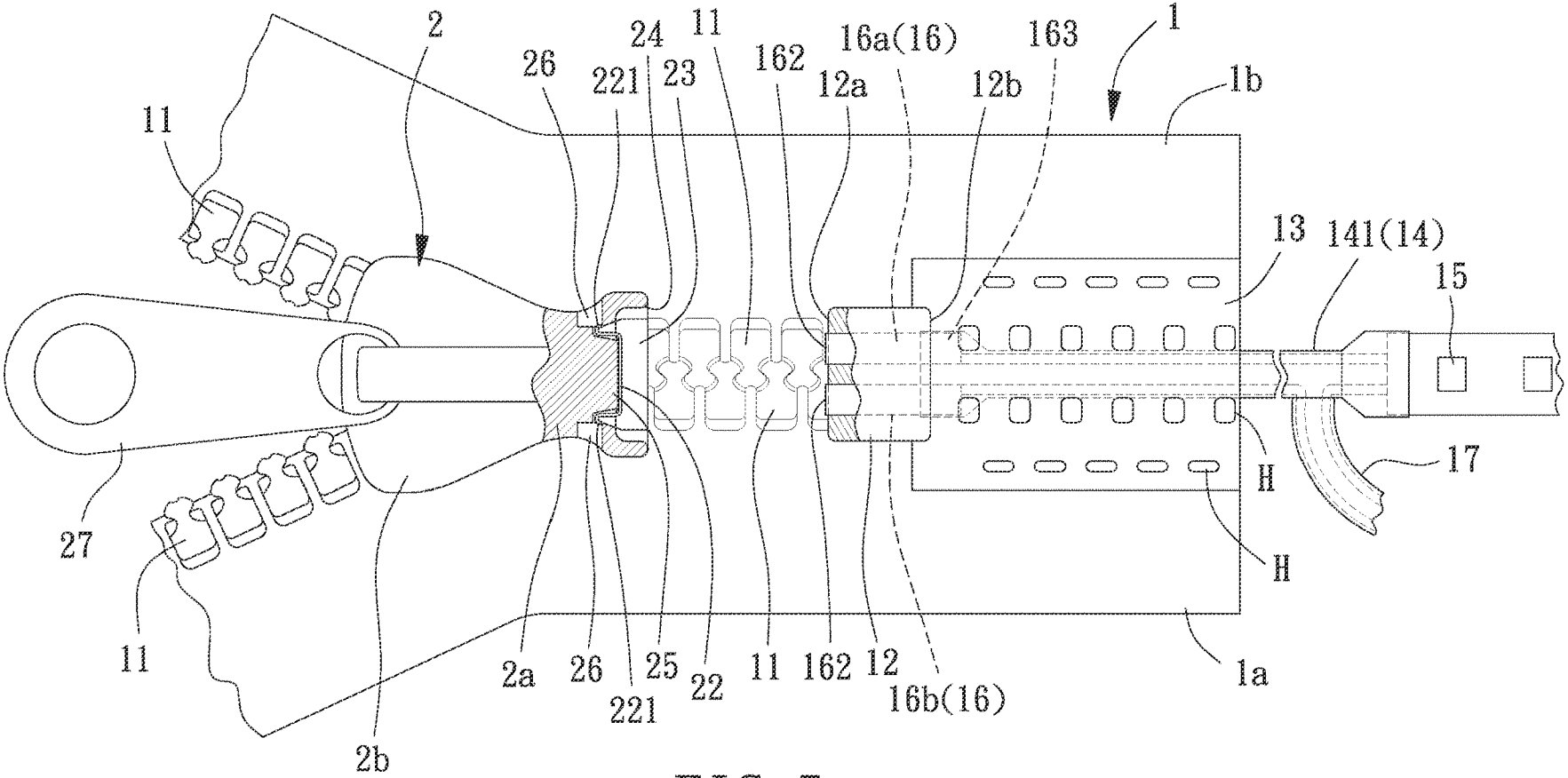
FIG. 5 is a side elevational view of the zipper of the first embodiment according to the present invention.

With reference to FIGS. 3 and 5, the lower body 2*a* preferably has a groove 23 receiving the second conductive plate 22. The groove 23 is aligned with the stop 12. The groove 23 and the first end 12*a* of the stop 12 have corresponding outlines, such that the first end 12*a* of the stop 12 extends into the groove 23 to achieve press-fit therebetween. Preferably, the groove 23 includes an opening having a radial size which gradually increases outwards. Thus, the opening of the groove 23 can form a guiding portion 24, such that the first end 12*a* of the stop 12 can extend into the groove 23 along the guiding portion 24.

The groove 23 includes a pressing block 25 extending towards the opening of the groove 23. A side of the pressing block 25 facing the opening of the groove 23 preferably forms a planar face. The pressing block 25 is associated with the first end 162 of each of the two first conductive plates 16 (16*a*, 16*b*). The second conductive plate 22 can be coupled to an outer face of the pressing block 25. Preferably, each of two ends of the second conductive plate 22 includes a hook 221 formed by bending. The lower body 2*a* includes two lateral sides each having a lateral hole 26 intercommunicating with the groove 23. Each hook 221 extends through an associated one of the lateral holes 26 and is hooked to a wall of the associated one of the lateral holes 26. Thus, the second conductive plate 22 can be fixed in the groove 23. A tool can extend through each lateral hole 26 to press against the associated hook 221 to thereby disengage the associated hook 221 from the wall of the associated lateral hole 26. This permits easy replacement of the second conductive plate 22. The slider 2 can further include a tab 27 for pulling the slider 2.

Figure 6:
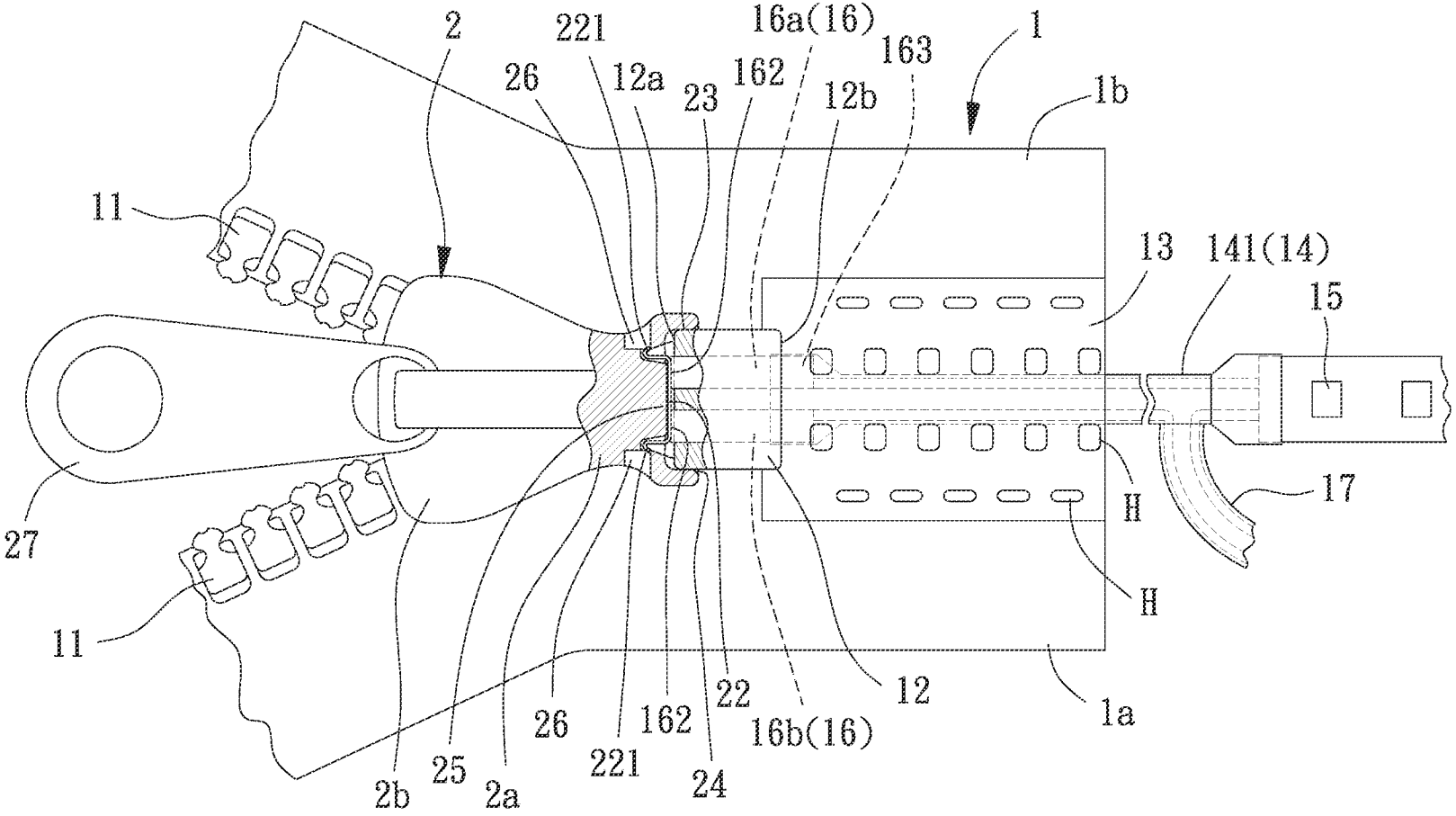
FIG. 6 is a side elevational view showing the zipper of the first embodiment according to the present invention in an electrical conduction state.

With reference to FIGS. 5, and 6, a user can connect the power connecting portion 17 with a power supply device (not shown), such as a battery or a portable charger. Then, the user can pull the tab 27 to move the slider 2. When the slider 2 reaches the stop 12, the first end 12*a* of the stop 12 extends into the groove 23, such that the second conductive plate 22 simultaneously contacts with the first ends 162 of the two first conductive plates 16 (16*a*, 16*b*), thereby causing electrical connection between the two first conductive plates 16 (16*a*, 16*b*). Specifically, the groove 23 and the first end 12*a* of the stop 12 are coupled together by press-fit to provide reliable contact between the second conductive plate 22 and the two first conductive plates 16 (16*a*, 16*b*). When the two first conductive plates 16 (16*a*, 16*b*) are in electrical connection with each other, an electric loop is formed between the at least one light-emitting element 15 and the power supply device. The electric current supplied by the power supply device activates the at least one light-emitting element 15 to emit light. When the slider 2 leaves the stop 12, an open circuit is formed between the two first conductive plates 16 (16*a*, 16*b*), such that the electric current cannot flow, and the light of the at least one light-emitting element 15 is put out. Thus, by engagement and disengagement of the slider 2 and the stop 12, the at least one light-emitting element 15 is switched on and off. Since the two first conductive plates 16 (16*a*, 16*b*) are received in the stop 12, the two first conductive plates 16 (16*a*, 16*b*) will not wear due to frictional contact with the slider 2. Furthermore, reliable contact with the second conductive plate 22 can be provided even if the two zipper tapes 1*a*, 1*b* are bent.

Figure 7:
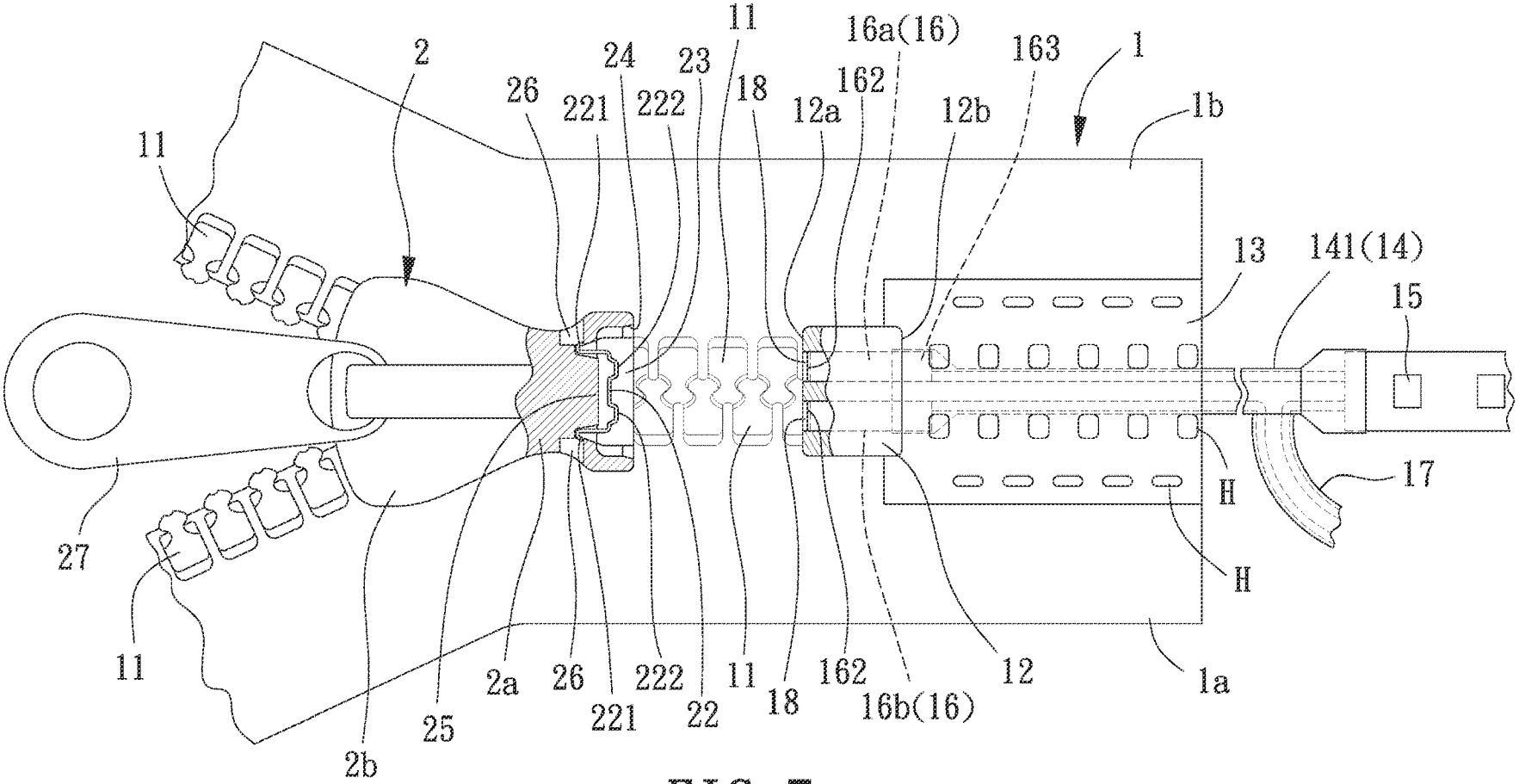
FIG. 7 is a side elevational view of a zipper of a second embodiment according to the present invention.
Figure 8:
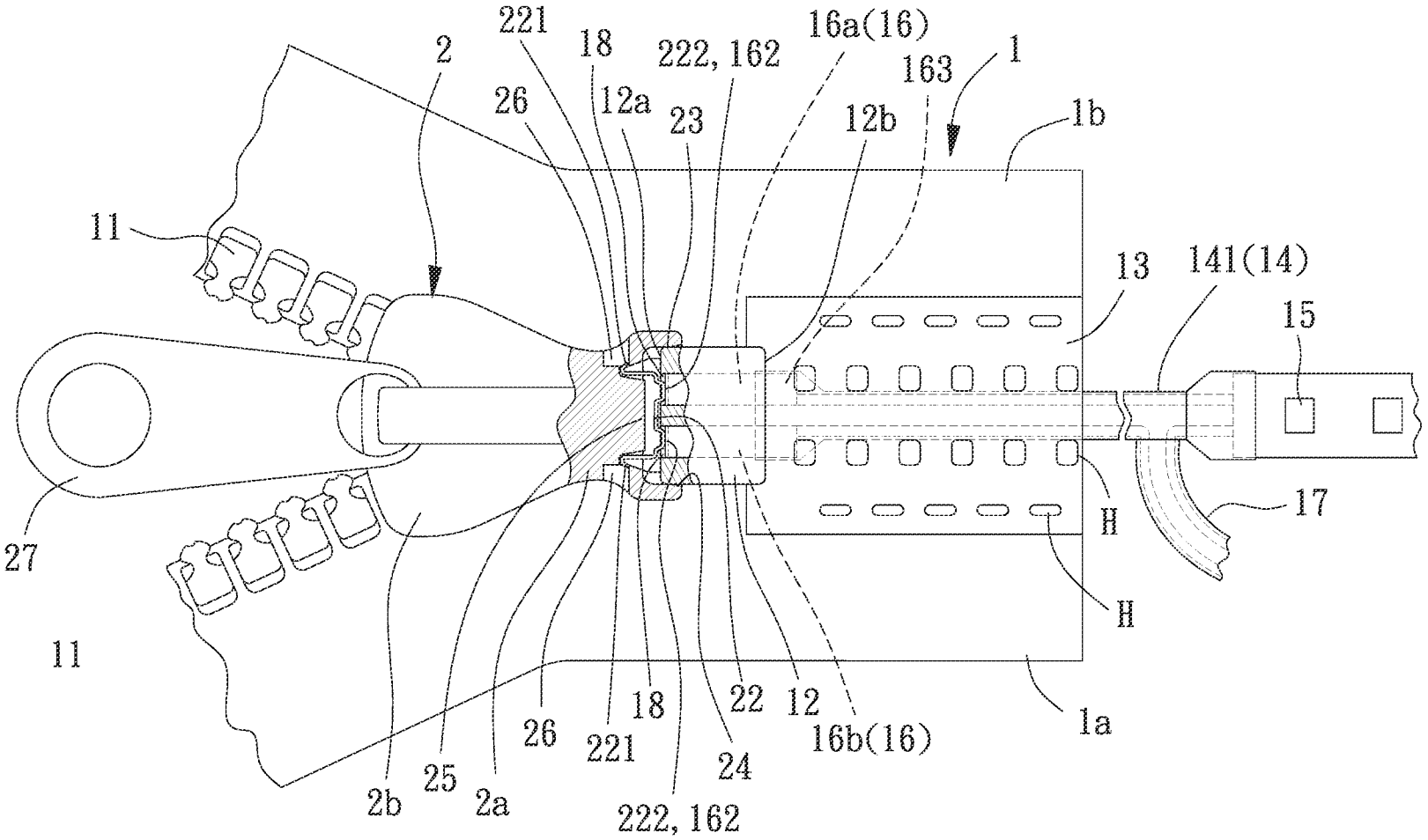
FIG. 8 is a side elevational view showing the zipper of the second embodiment according to the present invention in an electrical conduction state.

FIGS. 7 and 8 show a zipper with a light-emitting device of a second embodiment according to the present invention. In this embodiment, the first end 12*a* of the stop 12 includes two recessed portions 18 recessed from a face thereof. The first end 162 of each of the two first conductive plates 16 (16*a*, 16*b*) is exposed on a face of an associated one of the two recessed portions 18, The second conductive plate 22 includes two protrusions 222 respectively extending into the two recessed portions 18 to contact with the first ends 162 of the two first conductive plates 16 (16*a*, 16*b*), thereby causing electrical conduction between the two first conductive plates 16 (16*a*, 16*b*).

Figure 9:
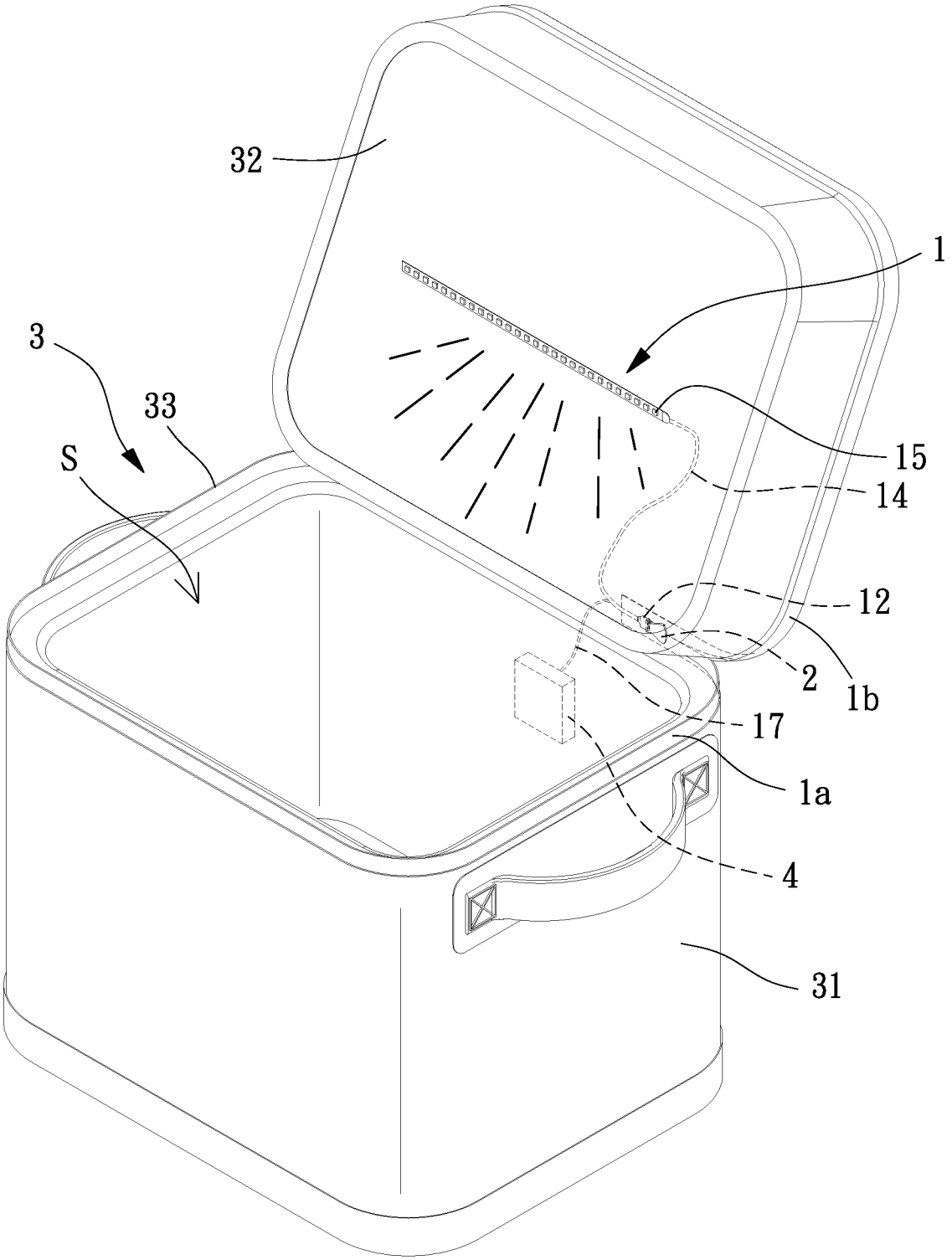
FIG. 9 is a perspective view illustrating use of the zipper according to the present invention on a container in an open state.

FIG. 9 is an embodiment showing use of the zipper with the light-emitting device according to the present invention on a container in an open state. This embodiment incudes a container 3, a power source 4 received in the container 3, and the zipper with the light-emitting device mentioned above.

In this embodiment, the container 3 includes a box body 31 and an upper cover 32. The box body 31 has a chamber S. The upper cover 32 can open or close the chamber S. Thus, an object can be placed into or removed from the chamber S via an opening 33. The power device 4 is embedded in the box body 31 and can be a power supply device, such as a dry battery, a solar battery, or a portable charger. The present invention is not limited in this regard. The zipper with the light-emitting device can be coupled to two edges of the opening 33. More specifically, the zipper tape 1*a* can be coupled to an edge of the opening 33 at the box body 31, and the other zipper tape 1*b* is coupled to an edge of the upper cover 32. The at least one light-emitting element 15 can be an LED lamp strip and can be disposed on the upper cover 32 to emit light towards the chamber S. The connecting wire 14 can be embedded in an interlayer of the upper cover 32 and is electrically connected to the at least one light-emitting element 15. Preferably, the power connecting portion 17 is embedded in an interlayer of the box body 31 and is electrically connected to the power device 4. Thus, the connecting wire 14 and the power connecting portion 17 are both received in the box body 31 to avoid exposure.

When the slider 2 is pulled to the stop 12, the rows of teeth 11 of the two zipper tapes 1*a*, 1*b* do not engage with each other, such that the upper cover 32 can be opened. Furthermore, the second conductive plate 22 simultaneously contacts with the first ends 162 of the two first conductive plates 16 (16*a*, 16*b*) to cause electrical conduction therebetween, as shown in FIG. 6. The at least one light-emitting element 15 emits light to illuminate the chamber S. Thus, even if in the darkness, the user can clearly see the chamber S of the box body 31 by the light. When the slider 2 is pulled to cause mutual engagement between the rows of teeth 11 of the two zipper tapes 1*a* and 1*b*, an open circuit is formed between the two first conductive plates 16 (16*a*, 16*b*), as shown in FIG. 5. Thus, the electric current cannot flow, and the light of the at least one light-emitting, element 15 is put out. Since the two first conductive plates 16 (16*a*, 16*b*) are disposed on the inner faces of the two zipper tapes 1*a*, 1*b*, the two first conductive plates 16 (16*a*, 16*b*) are isolated from the outside. Furthermore, each of the two zipper tapes 1*a*, 1*b* can have a waterproof material to avoid short circuit of the two first conductive plates 16 (16*a*, 16*b*) resulting from moisture outside of the container 3.

Figure 10:
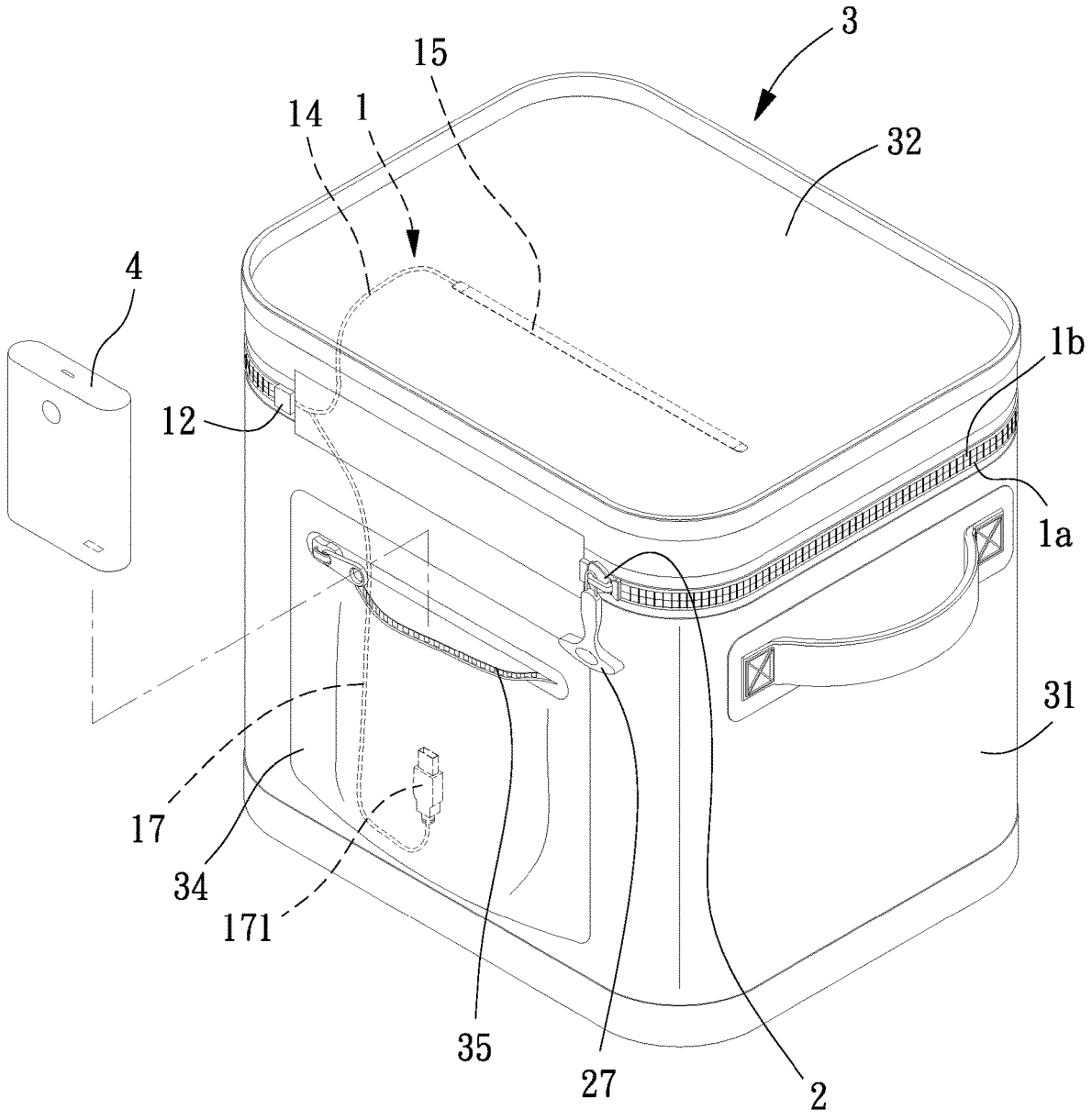
FIG. 10 is a perspective view of the container in a closed state.
Figure 11:
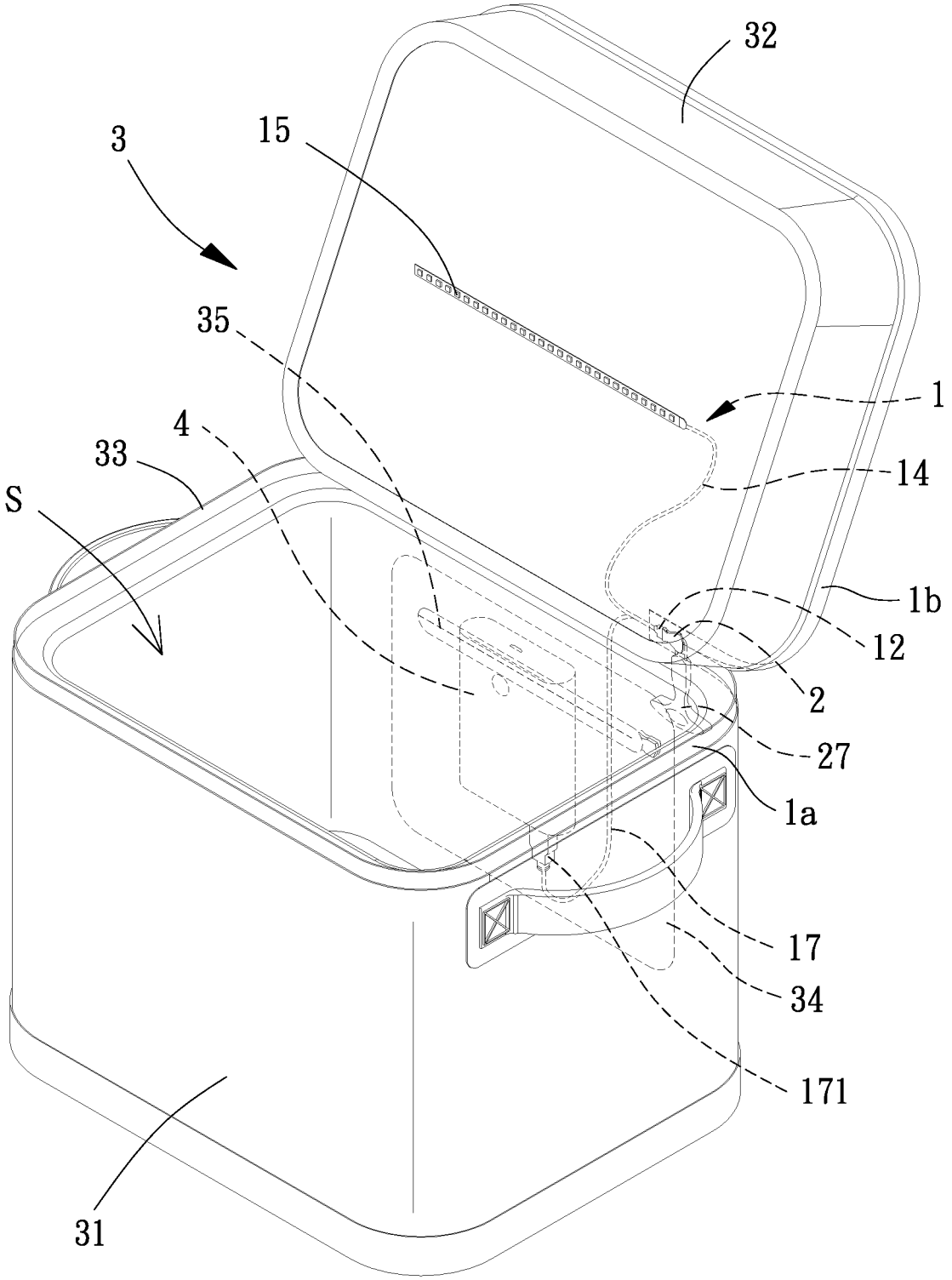
FIG. 11 is a perspective view showing another example of use of the zipper according to the present invention on a container in an open state.

FIGS. 10 and 11 show another example of use of the zipper with the light-emitting element according to the present invention. In this embodiment, the container 3 further includes a side bag 34 disposed on an outer face of a side of the container 3. The power connecting portion 17 and the power device 4 are received in the side bag 34. The side bag 34 can have a sealing opening 35 to best store the power device 4 in the side bag 34. Preferably, the electrical connecting portion 17 includes a coupler 171 which can be a USB connector. The power device 4 can be a portable charger. Thus, the power connecting portion 17 can be rapidly coupled with or disconnected from the power device 4. When the power device 4 runs out of power, the user can easily remove the power device 4 from the side bag 34 via the sealing opening 35 for charging purposes or can replace it with another power device 4 with full power.

Figure 13:
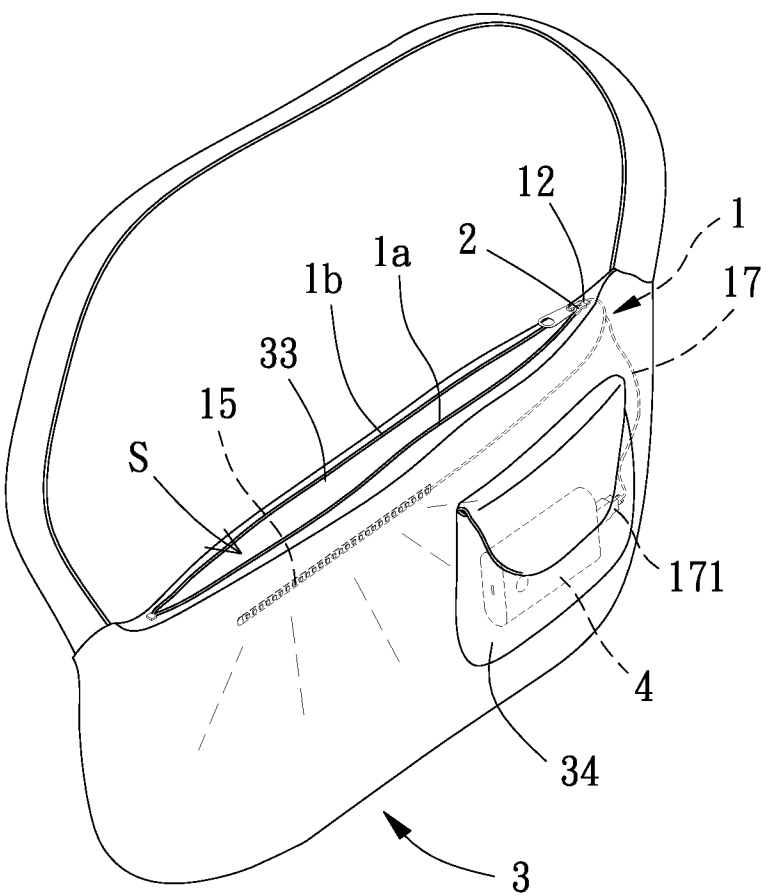
FIG. 13 is a perspective view illustrating use of the zipper according to the present invention on the handbag in an open state.
Figure 12:
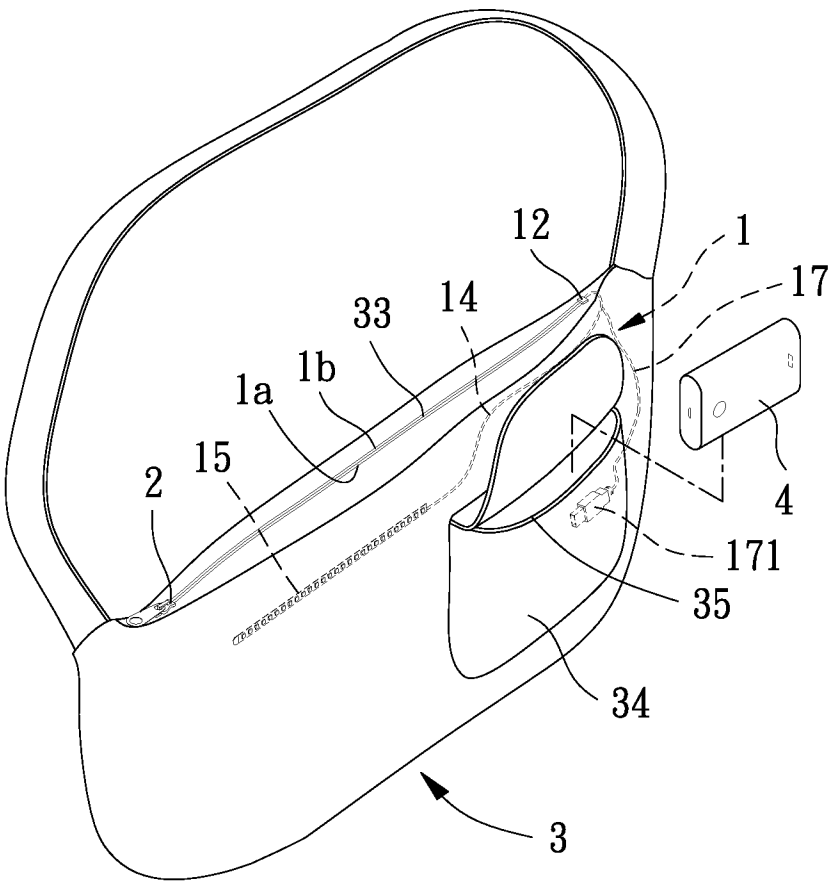
FIG. 12 is a perspective view illustrating use of the zipper according to the present invention on a handbag in a closed state.

FIGS. 12 and 13 show use of the zipper with the light-emitting element according to the present invention on a handbag. Specifically, the container 3 is a handbag in this embodiment and has body having an opening 33. The two zipper tapes 1*a*, 1*b* are coupled to two edges of the opening 33, The at least one light-emitting element 15 can be an LED lamp strip and is received in the chamber S. Preferably, the body of the container 3 further includes a side bag 34 having an interior intercommunicating with the chamber S. The coupler 171 of the power connecting portion 17 extends from the chamber S into the interior of the side bag 34. The power device 4 is received in the side bag 34, such that the power connecting portion 17 can be electrically connected to the power device 4 via the coupler 171. When the slider 2 is pulled to the stop 12, the second conductive plate 22 simultaneously contacts with the first ends 162 of the two first conductive plates 16 (16*a*, 16*b*) to cause electrical conduction therebetween, as shown in FIG. 6. The at least one light-emitting element 15 in the chamber S emits light to provide illumination. Thus, the user can clearly see the chamber S of the handbag by the light. Since the two first conductive plates 16 (16*a*, 16*b*) will not in frictional contact with the slider 2, wear is avoided. Furthermore, poor contact between the two first conductive plates 16 (16*a*, 16*b*) and the second conductive plate 22 resulting from bending of the two zipper tapes 1*a*, 1*b* is also avoided. Thus, the at least one light-emitting element 15 can emit light stably. When the slider 2 is pulled to cause mutual engagement of the rows of teeth 11 of the two zipper tapes 1*a*, 1*b*, an open circuit is formed between the two first conductive plates 16 (16*a*, 16*b*), as shown in FIG. 5. Thus, the electric current cannot flow, and the light of the at least one light-emitting element 15 is put out. Since the two first conductive plates 16 (16*a*, 16*b*) are isolated from the outside, short circuit resulting from contact between the two first conductive plates 16 (16*a*, 16*b*) and a conductive external object outside of the container 3 is avoided.

In view of the foregoing, in the zipper with the light-emitting device according to the present invention and the container with the zipper, when the slider is pulled to the stop, the at least one light-emitting element emits light to illuminate the chamber of the container. When the slider is pulled to cause mutual engagement between the rows of teeth of the two zipper tapes, the light of the at least one light-emitting element is put out. Furthermore, the slider can have a groove. The first end of the stop can extend into the groove to provide press-fit therebetween, assuring a stable circuit loop. Moreover, the two first conductive plates are received in the stop and are located on the inner face side of the two zipper tapes, and each of the two zipper tapes can have a waterproof material. Thus, erroneous conduction of the two first conductive plates resulting from contact with conductive external objects or moisture can be avoided. In addition, wear to the two first conductive plates 16 resulting from frictional contact with the slider can be avoided. Further, unreliable conduction resulting from bending of the two zipper tapes is also avoided.

In view of the foregoing, in the zipper with the light-emitting device according to the present invention and the container with the zipper, when the slider is pulled to the stop, the at least one light-emitting element emits light to illuminate the chamber of the container. When the slider is pulled to cause mutual engagement between the rows of teeth of the two zipper tapes, the light of the at least one light-emitting element is put out. Furthermore, the slider can have a groove. The first end of the stop can extend into the groove to provide press-fit therebetween, assuring a stable circuit loop. Moreover, the two first conductive plates are received in the stop and are located on the inner face side of the two zipper tapes, and each of the two zipper tapes can have a waterproof layer. Thus, erroneous conduction of the two first conductive plates resulting from contact with conductive external objects or moisture can be avoided. In addition, wear to the two first conductive plates 16 resulting from frictional contact with the slider can be avoided. Further, unreliable conduction resulting from bending of the two zipper tapes is also avoided.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A zipper with a light-emitting device, comprising:

a tape body including two zipper tapes each including an inner edge having a row of teeth, wherein a stop is coupled to the two zipper tapes and includes a first end connected to distal ends of the rows of teeth, wherein the stop includes a second end opposite to the first end of the stop, wherein the tape body further includes two first conductive plates received in the stop, wherein each of the two first conductive plates has a first end exposed outside of the first end of the stop, wherein each of the two first conductive plates has a second end located outside of the second end of the stop and received in a conduit of a connecting wire, wherein the second end of one of the two first conductive plates is electrically connected to an electrode of at least one light-emitting element, wherein a power connecting portion is electrically connected to the second end of another of the two first conductive plates and another electrode of the at least one light-emitting element; and a slider slidably disposed on the rows of teeth for engaging or disengaging the rows of teeth, wherein the slider includes a second conductive plate configured to simultaneously contact with the two first conductive plates, causing electrical conduction to activate the at least one light-emitting element to emit light.

2. The zipper with the light-emitting device as claimed in claim 1, wherein each of the two zipper tapes includes a waterproof material.

3. The zipper with the light-emitting device as claimed in claim 1, wherein the tape body further includes a reinforced portion connected to the second end of the stop.

4. The zipper with the light-emitting device as claimed in claim 3, wherein the reinforced portion is in a form of a sheet having a plurality of holes.

5. The zipper with the light-emitting device as claimed in claim 1, wherein each of the two first conductive plates received in the stop has a bend.

6. The zipper with the light-emitting device as claimed in claim 1, wherein the first end of each of the two first conductive plates is at an inner face side of the two zipper tapes.

7. The zipper with the light-emitting device as claimed in claim 1, wherein the slider includes a groove receiving the second conductive plate, and wherein the first end of the stop extends into the groove to provide press-fit therebetween.

8. The zipper with the light-emitting device as claimed in claim 7, wherein the groove includes an opening having a radial size which gradually increases outwards.

9. The zipper with the light-emitting device as claimed in claim 8, wherein the groove includes a pressing block extending towards the opening of the groove and is associated with the first end of each of the two first conductive plates, and wherein the second conductive plate is coupled to an outer face of the pressing block.

10. The zipper with the light-emitting device as claimed in claim 7, wherein each of two ends of the second conductive plate includes a hook, wherein the slider includes two lateral sides each having a lateral hole intercommunicating with the groove, and wherein each of the hooks extend through an associated one of the lateral holes and is hooked to a wall of the associated one of the lateral holes.

11. The zipper with the light-emitting device as claimed in claim 7, wherein the first end of the stop includes two recessed portions recessed from a face thereof, wherein the first end of each of the two first conductive plates is exposed on a face of an associated one of the two recessed portions, wherein the second conductive plate includes two protrusions extending into the two recessed portions, respectively.

12. A container comprising:

a body including a chamber having an opening for receiving and removing an object; and the zipper with the light-emitting device set forth in claim 1, wherein the zipper is coupled to two edges of the opening, wherein the power connecting portion is configured to be electrically connected to a power device, and wherein the at least one light-emitting element provides illumination for the chamber.

13. The container as claimed in claim 12, further comprising an upper cover for covering the opening of the body, and wherein the at least one light-emitting element is disposed on the upper cover to emit light towards the chamber.

14. The container as claimed in claim 13, wherein the connecting wire is embedded in an interlayer of the upper cover and is electrically connected to the at least one light-emitting element, and wherein the power connecting portion is embedded in an interlayer of the body.

15. The container as claimed in claim 12, wherein the body includes a side bag, and wherein the power connecting portion and the power device are received in the side bag.

16. The container as claimed in claim 12, wherein the power connecting portion includes a coupler.

17. The container as claimed in claim 16, wherein the coupler is a USB connector.

18. The container as claimed in claim 12, wherein the power device is a portable charger.

* * * * *